United States Patent [19]

Holmgren et al.

[11] 4,355,477

[45] Oct. 26, 1982

[54] WORKING MACHINE WITH IMPROVED JIB SECTION

[75] Inventors: Lars Holmgren; Per-Martin Holmgren, both of Skelleftea, Sweden

[73] Assignee: Aktiebolaget P. E. Holmgren, Skelleftea, Sweden

[21] Appl. No.: 246,066

[22] Filed: Mar. 20, 1981

[30] Foreign Application Priority Data

Mar. 24, 1980 [SE] Sweden ..... 8002258

[51] Int. Cl.[3] ..... E02F 3/76

[52] U.S. Cl. ..... 37/117.5; 414/685; 414/722

[58] Field of Search ..... 37/103, 117.5; 414/722, 414/685, 686, 688, 696

[56] References Cited

U.S. PATENT DOCUMENTS

| | | | |
|---|---|---|---|
| 2,768,760 | 10/1956 | Pilch | 414/722 |
| 3,237,795 | 3/1966 | Kromer | 37/117.5 X |
| 3,441,155 | 4/1969 | Norton | 37/103 |
| 3,584,751 | 6/1971 | Bellart | 37/103 X |
| 3,794,191 | 2/1974 | Kuhn | 414/685 |
| 3,802,586 | 4/1974 | Lofgreen | 414/722 |
| 4,077,140 | 3/1978 | Branconi | 37/103 |
| 4,257,732 | 3/1981 | Staffanson | 414/685 |

FOREIGN PATENT DOCUMENTS

| | | | |
|---|---|---|---|
| 2411051 | 3/1974 | Fed. Rep. of Germany | 414/685 |
| 2628655 | 12/1977 | Fed. Rep. of Germany | 37/117.5 |
| 1320691 | 6/1973 | United Kingdom | 414/722 |

*Primary Examiner*—E. H. Eickholt

*Attorney, Agent, or Firm*—Fleit & Jacobson

[57] ABSTRACT

A working machine which is intended for demolishing and excavating work comprises a chassis, an upper part carried by said chassis and arranged for rotational movement relative thereto about a vertical axis, and an arm arrangement carried by the upper part and including a jib structure which is connected at one end thereof to the upper part and the other end of which carries, via an intermediate arm, a fitting for a tool, such as an excavator bucket, a chiseling device or like tool. The jib structure and the intermediate arm are connected to the upper part and to each other respectively via pivots and can be pivoted in a vertical plane by means of first and second pressure piston-cylinder devices active between the upper part and the jib structure and between the jib structure and the intermediate arm respectively. The jib structure is divided into a first, short jib section which is pivotally connected to the upper part, and a second, longer jib section which is pivotally connected to the first jib section. The first jib section is connected to the first pressure cylinder device, while the second jib section is connected to the second pressure cylinder device. Further, the jib sections can be pivoted relative to one another in the vertical plane by means of a further pressure cylinder device acting between the jib sections; whereat a given one of said first and said further pressure cylinder devices can only be driven together with the other; and whereat the arrangement of the first and the further pressure cylinder devices is such that when they operate simultaneously they swing the jib sections at the same angular speed in opposite directions.

6 Claims, 3 Drawing Figures

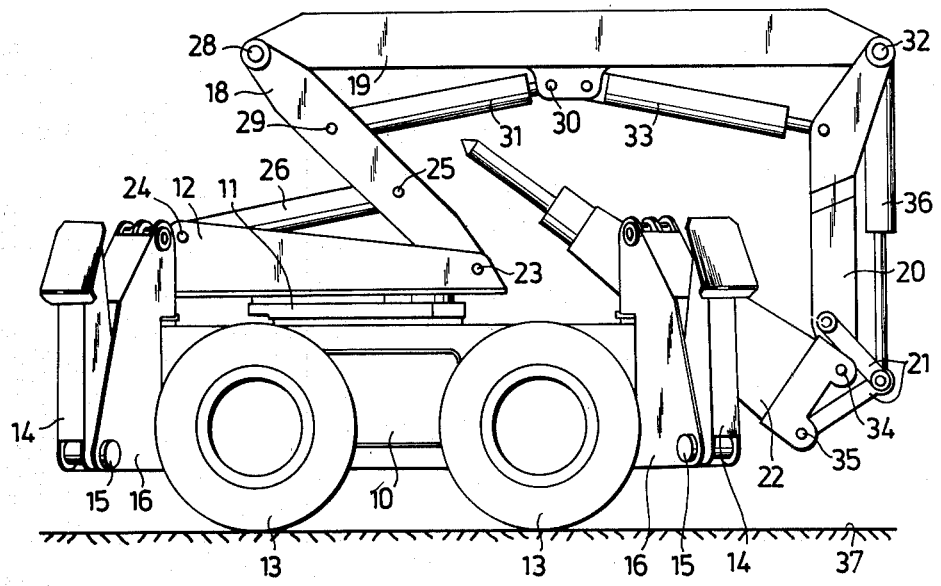
Fig. 2
Fig. 3
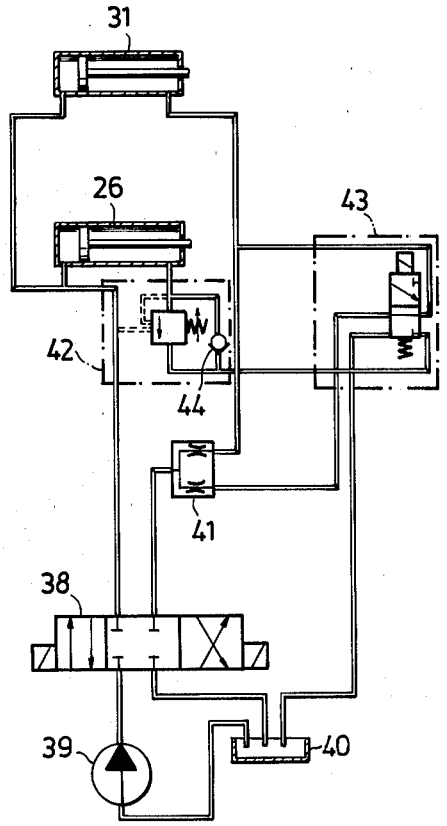

WORKING MACHINE WITH IMPROVED JIB SECTION

The present invention relates to a working machine of the kind which is intended primarily for work in the specialized demolition, repair and rebuilding of concrete structures, including the clearing of slag or the stripping of linings from metallurgical vessels, such as large ladles, furnaces, mixers etc., but which can also be used for excavating purposes and which is provided with means whereby said machine can be fitted with the appropriate tool as required, thereby rendering the machine universal.

Present day machines of the kind envisaged and having an extensive working range are bulky and cumbersome, however, besides being difficult to manoeuvre and having a complicated design.

Consequently an object of the invention is to provide such a machine which is of relatively simple design. A further object is to provide such a machine which has a relatively wide working range, so that the machine is able to reach work areas located directly beneath and above said machine and work areas at relatively far distances from the machine, in all directions. Yet another object is to provide such a machine which can be collapsed to a state in which the machine can work effectively and the jib structure can be extended fully in spaces having a relatively low ceiling height.

To this end there is proposed a working machine for such work as demolishing and excavating operations comprising a chassis; an upper part arranged on said chassis for rotation about a substantially vertical axis; an arm arrangement carried by said upper part and consisting of a first, short jib section pivotally connected at one end thereof directly to said upper part, and a second, longer jib section pivotally connected at one end thereof to the free end of said first jib section; an intermediate arm pivotally connected at one end to the free end of said second jib section and carrying at the other end thereof a tool fitting; a first pressure cylinder device operative between said upper part and said first jib section; a second pressure cylinder device operative between said second jib section and said intermediate arm; a further pressure cylinder device operative between said first and said second jib sections; and means for controlling said first and said further pressure cylinder devices such that a given one of said devices can only be driven together with the other, whereat the arrangement of said first and said further cylinder devices is such that when they operate simultaneously they swing the jib sections at the same angular speed in opposite directions.

By means of such an arrangement the machine obtains a very wide working range, and the working tool is able to reach beneath and below the machine and high up centrally above said machine in every selected position of rotation of the upper part relative to the chassis. In addition, the machine is readily manoeuvred and operated.

In accordance with one advantageous embodiment of the invention, the first pressure cylinder device is arranged so as only to be drivable together with the further pressure cylinder device. One advantage afforded hereby is that the second, longer jib section will always move substantially in the direction of its own geometrical extension when extending or retracting the jib structure, thereby facilitating work in confined spaces.

In order to enable the machine to be operated with the aid of a relatively simple control system the first and further pressure cylinder devices are preferably mutually identical and are connected respectively between the first jib section and said upper part and said first jib section and second jib section in a functionally coinciding manner.

Since the space in which the machine is to work may often have a low ceiling height it is desirable that the machine can be collapsed to a compact form, and still be able to work at a low working height. This can be achieved by ensuring that the longer jib section is substantially horizontal when the pistons of the first and further pressure cylinder devices are fully withdrawn. In addition hereto the first, short jib section is preferably arranged so that it can be swung through substantially equal angles on both sides of a line passing vertically through the pivot point thereof connecting said jib section to the chassis.

Other features of the machine according to the invention and advantages afforded by said machine are disclosed in the depending claims and will be apparent from the following description made with reference to a preferred embodiment of the invention illustrated in the drawings.

FIG. 2 is a side view of the machine shown in FIG. 1 in larger scale, with the arm arrangement in a folded state, therewith minimizing the space required by the machine.

FIG. 3 illustrates schematically a simple arrangement for driving the first and further pressure cylinder devices associated with the sectioned jib structure.

Figure 1:
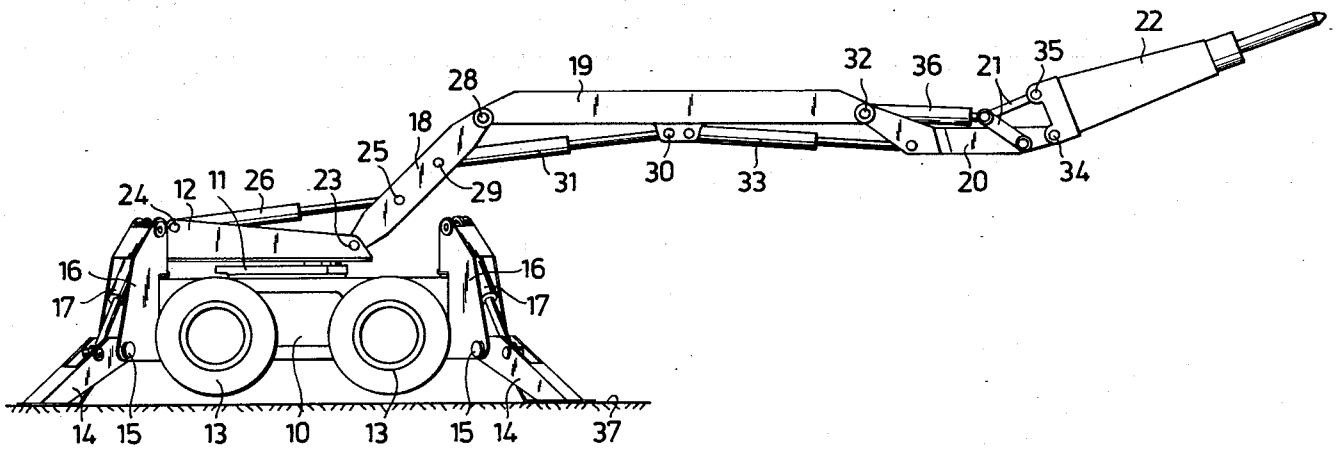
FIG. 1 is a side view of a working machine according to the invention with the arm arrangement extended to its maximum.

The working machine illustrated in FIGS. 1 and 2 includes a chassis 10, and an upper part 12 which is carried by said chassis 10 via a turntable 11, and which is rotatable relative to said chassis about a vertical axis. The chassis 10 is provided with wheels 13 and support legs 14. The support legs 14 are pivotally mounted at 15 in holders 16 located in the corner regions of the chassis, said support legs being pivotable by means of hydraulic piston-cylinder devices 17 between the downwardly swung position illustrated in FIG. 1, in which they support the working machine, and the upwardly swung position shown in FIG. 2, in which the working machine is supported by the wheels 13. The holders 16 with the support legs 14 extend outwardly at an angle of about 45° relative to the longitudinal direction of the machine, so that the machine is firmly supported by said legs 14. So that the machine obtains a minimal width, thereby to enable it, for example, to be lifted through narrow passages, such as door openings, furnace openings etc., each holder 16 may be pivotally arranged about a vertical axis, so that said holders take a position parallel to the longitudinal direction of the machine, and the wheels 13 or like elements, such as caterpillar tracks or the like, may be attached to the machine in a manner which enables them to be readily removed therefrom.

The upper part 12 carries an arm arrangement, comprising a jib structure having two sections 18, 19, said jib structure pivotally supporting a tool 22 via a pivotable so-called stick or intermediate arm 20 and a rocker arrangement 21, said tool in the illustrated embodiment comprising a chiseling device.

The jib section 18, which is approximately half the length of the jib section 19, is journalled directly to the upper part 12 at 23 and is arranged to be swung through an angle of about 90° between the positions shown in FIGS. 1 and 2 by means of a hydraulic piston-cylinder device 26 which is pivotally connected to the upper part 12 at 24 and to the jib section 18 at 25. The jib section 19 is journalled to the jib section 18 at 28 and is arranged to be swung through about 90° relative to the jib section 18, between the positions shown in FIGS. 1 and 2, by means of a hydraulic piston-cylinder device 31 pivotally mounted to the jib section 18 at 29 and to the jib section 19 at 30. In a similar manner, the intermediate arm 20 is journalled to the jib section 19 at 32 and is arranged to be swung through an angle of about 90° relative to the jib section 19 between the positions shown in FIGS. 1 and 2, by means of a hydraulic piston-cylinder device 33; and the tool 22 is journalled to the intermediate arm 20 and to the rocker arrangement 21 at 34 and 35 respectively and is arranged to be swung relative to the intermediate arm 20 between the positions shown in FIGS. 1 and 2, by means of piston-cylinder device 36.

By means of the illustrated arm arrangement the machine obtains a very wide working range, whereat the machine in every selected position of rotation of the upper part 12 relative to the chassis 10 is able to reach far below and beneath the machine as well as high up, centrally above the machine. Further, when collapsed to the state illustrated in FIG. 2, e.g. for transport purposes, the machine has a low height, owing to the fact that the second jib section 19 is substantially horizontal when the hydraulic piston-cylinder devices 26, 31 occupy their fully withdrawn position; and because the first jib section 18 can be swung through approximately 45° in both directions from a vertical upstanding position, and through suitable proportioning of the arm arrangement in other respects there is required for complete extension of said arm arrangement a free height which only slightly exceeds the height which the machine has when the arm arrangement is folded for transportation purposes.

One of the hydraulic piston-cylinder devices 26 and 31, preferably the piston-cylinder device 26, can only be driven together with the other. This greatly facilitates the working operation of the machine, since the machine can then be operated substantially as a conventional excavating machine. The hydraulic system required for driving the working machine, such as wheel motors, hydraulic pumps, hydraulic-liquid tank, and the motor for rotating the upper part 12, are preferably incorporated in the chassis 10. The hydraulic system is preferably operated electrically, whereat pump motors etc. can also be placed, to advantage, within the chassis. The working machine is preferably remotely controlled, for example by means of an operating device carried by the machine operator, which device is connected by means of a cable to an electrically controlled servo-system incorporated in the working machine, for porportional remote control. In this way the operator need only have the machine in his sight, and may be positioned in a location shielded from the working environment of the machine, so that he is not exposed to dust etc. formed as the machine carries out its work.

In the illustrated embodiment it is assumed that the working machine operates in the same movement pattern as a conventional excavator, with the exception of the co-action of the hydraulic piston-cylinder devices 26 and 31. Consequently, only the manner in which these latter piston-cylinder devices are controlled will be described hereinafter. In order to simplify the arrangement, and to enable uncomplicated and inexpensive control-system components to be used for the hydraulic piston-cylinder devices 26, 31, these piston-cylinder devices may advantageously be identical and may be connected between the jib section 18 and the upper part 12, and the jib section 19 respectively in a functionally coinciding manner. FIG. 3 illustrates one such simplified control system, whereat the working machine is assumed to operate in accordance with the movement pattern of a conventional excavating machine while using solely the hydraulic piston-cylinder devices 31, 33 and 36, with the exception of when the arm arrangement is extended or shortened by simultaneous operation of the piston-cylinder devices 26, 31. When the arm arrangement is extended or shortened, the jib section 19 retains its attitude in relation to the chassis 37, thereby greatly simplifying manoeuvring of the machine.

The control system illustrated in FIG. 3 for controlling the hydraulic piston-cylinder devices 26, 31 includes a directional valve 38 via which hydraulic liquid can be forced, by means of a pump 39, from a tank 40 to either solely the cylinder 31 or to both of the cylinders 26, 31. With the valve 38 displaced to the right in FIG. 3, hydraulic liquid is passed to the positive side of the cylinder 31 or to the positive sides of the cylinders 26, 31, while hydraulic liquid is passed to the negative side or sides of the cylinder or cylinders respectively when the valve 38 is displaced in the opposite direction. The illustrated control system also includes a flow divider 41, a load sensing valve 42 and a selector valve 43. When the selector valve 43 occupies the illustrated position, in which it prevents the flow of hydraulic liquid both from and to the negative side of the piston-cylinder device 26, only the cylinder 31 will be driven when the valve 38 is opened. If hydraulic liquid is then passed to the positive side of the piston-cylinder device 31, because of the presence of the flow divider 41 half of the flow of hydraulic liquid from the negative side of the piston-cylinder device 31 will pass to and through the flow divider 41 via the selector valve 43, while the other half of said flow is passed directly to and through the flow divider. When hydraulic liquid is supplied to the negative side of the piston-cylinder device 31, the flow of hydraulic liquid is divided by the flow divider into two equal flows, of which one flow passes directly to the piston-cylinder device 31, while the other flow passes to said device 31 via the selector valve 43. It will be seen that the functions of the control system described hitherto are used for operating the working machine in accordance with a pattern of movement characteristic of a conventional excavating machine. To permit the arm arrangement to be extended and withdrawn, the selector valve 43 is set to a different position than the illustrated position. When the directional valve 38 is set to the right, the hydraulic liquid passes directly to the positive side of the two piston-cylinder devices 26, 31. The hydraulic liquid passes from the negative side of the piston-cylinder device 31 directly to the flow divider 41, while an equally large flow of hydraulic liquid passes from the negative side of the piston-cylinder device 26 to the flow divider 41 via the load-sensing valve 42 and the selector valve 43. The valve 42 will only allow hydraulic liquid from the negative side of the piston-cylinder device 26 to pass through when the pressure on said negative side is slightly lower than the pressure on the positive side of said device 26, thereby to avoid problems originating from the occurrence of an underpressure on the positive side of the piston-cylinder device 26 when the arm arrangement approaches its maximum extended position. When the directional valve 38 occupies its left-hand position, half the flow of hydraulic liquid from the flow divider 41 is passed directly to the negative side of the piston-cylinder device 31, while the other half of the flow of hydraulic liquid passes to the negative side of the piston-cylinder device 26 via the valve 43 and a check valve 44 incorporated in the load-sensing valve 42. When the positions of the valves 38 and 43 are adjusted in relation to the positions shown in FIG. 3, an equally large flow of hydraulic liquid is passed to one or the other side of both piston-cylinder devices 26 and 31 until the piston of the device 31 has completed its working stroke, whereat the jib section 18 is swung relative to the upper part 12 and the jib section 19 is swung relative to the jib section 18 at mutually the same angular speed, and whereat the jib section 19, irrespective of the starting position of the piston-cylinder device 31 and the subsequent angle of inclination of the jib section 19 relative to the foundation 37, retains its angle of inclination relative to said foundation 37 while the arm arrangement is being extended or folded.

The invention is not restricted to the described and illustrated embodiment, but said embodiment can be modified within the scope of the accompanying claims.

We claim:

1. A working machine for such work as demolishing and excavating operations, comprising a chassis; an upper part arranged on said chassis for rotation about a substantially vertical axis; an arm arrangement carried by said upper part and consisting of a first, short jib section pivotally connected at one end thereof directly to said upper part, and a second, longer jib section pivotally connected at one end thereof to the free end of said first jib section; an intermediate arm pivotally connected at one end to the free end of said second jib section and carrying at the other end thereof a tool fitting; a first pressure cylinder device operative between said upper part and said first jib section; a second pressure cylinder device operative between said second jib section and said intermediate arm; a further pressure cylinder device operative between said first and said second jib sections; and means for controlling said first and said further pressure cylinder devices such that a given one of said devices can only be driven together with the other, whereat the arrangement of said first and said further cylinder devices is such that when they operate simultaneously they swing the jib sections at the same angular speed in opposite directions.

2. A working machine according to claim 1, wherein said first pressure cylinder device is arranged so as only to be drivable together with said further pressure cylinder device.

3. A working machine as claimed in claim 1 or claim 2, wherein said first and further pressure cylinder devices are mutually identical and are connected between the first jib section and said upper part and said second jib section respectively in a functionally coinciding manner.

4. A working machine according to claim 3, wherein the second jib section is substantially horizontal when said first and further pressure cylinder devices are in their fully withdrawn positions.

5. A working machine according to claim 4, wherein said first jib section can be swung through substantially equal angles on both sides of a line passing vertically through its pivot point at said one end thereof.

6. A working machine according to claim 1 or claim 2, wherein the second jib section is substantially horizontal when said first and further pressure cylinder devices are in their fully withdrawn positions.

* * * * *